US005454429A

United States Patent [19]

Neurauter

[11] Patent Number: 5,454,429

[45] Date of Patent: Oct. 3, 1995

[54] RODS AND MANDREL TURBULATORS FOR HEAT EXCHANGER

[76] Inventor: Peter Neurauter, Damaschkestrasse 61, 8520 Erlangen, Germany

[21] Appl. No.: 63,503

[22] Filed: May 18, 1993

[51] Int. Cl.[6] ..... F28F 13/12

[52] U.S. Cl. ..... 165/109.1; 165/159; 138/38

[58] Field of Search ..... 165/109.1, 159, 165/181, 160; 138/38

[56] References Cited

U.S. PATENT DOCUMENTS

| | | | |
|---|---|---|---|
| 609,499 | 8/1898 | Chatwood et al. | 138/38 X |
| 665,912 | 1/1901 | Jolicard | 138/38 X |
| 948,835 | 2/1910 | Walter | 165/160 |
| 1,454,053 | 5/1923 | Jones | 165/161 |
| 1,782,409 | 11/1930 | Chute | 165/161 |
| 1,867,163 | 7/1932 | Loebell . | |
| 2,210,031 | 8/1940 | Greene | 165/109.1 X |
| 2,384,714 | 9/1945 | Villiger | 165/161 |
| 2,937,079 | 5/1960 | Van Pool | 165/159 |
| 3,400,758 | 9/1968 | Lee | 165/159 |
| 3,749,155 | 7/1973 | Buffiere | 138/38 X |
| 3,983,861 | 10/1976 | Beauchaine | 138/38 X |
| 4,360,059 | 11/1982 | Funke | 165/160 |
| 4,493,368 | 1/1985 | Gronnerud et al. | 165/159 |

FOREIGN PATENT DOCUMENTS

| | | | |
|---|---|---|---|
| 28396 | of 1905 | United Kingdom | 165/159 |

*Primary Examiner*—Martin P. Schwadron
*Assistant Examiner*—L. R. Leo
*Attorney, Agent, or Firm*—Brown, Martin, Haller & McClain

[57] ABSTRACT

The heat exchange comprises a housing of tube-shaped inside cross-section as part of an outer thermal cycle, and at least one tube attached in the housing as part of a second thermal cycle. Each tube is formed from a flexible material. The tubes and housing comprise separate inlets and outlets, and at least one element is disposed transversely to the longitudinal housing axis to fit tightly within the housing crosssection to provide passages for the tubes. The element is shaped as a helix so that the tubes are flowed around in a helical fashion by the medium contained in the first thermal cycle. The helical element forces a flow which passes diagonally at a tangent against and around the tubes.

13 Claims, 4 Drawing Sheets

RODS AND MANDREL TURBULATORS FOR HEAT EXCHANGER

BACKGROUND OF THE INVENTION

The present invention relates to a heat exchanger in which two media having different temperatures are conducted in separate cycles. As a rule, the cycle in which the warmer medium is conducted is called the primary cycle, and the cycle in which the cooler medium is conducted is called the secondary cycle.

In order to achieve a high efficiency of a heat exchanger, the boundary area separating the two media should be as thin as possible, have a largest possible surface area and a good thermal conductivity. Additionally, the efficiency can further be improved by the media flowing in opposite directions to each other.

A heat exchanger having a tube arrangement for the heat-absorbing medium and an outer jacket for the heat-dissipating medium has already been proposed wherein the tube arrangement encompasses very thin tubes of intertwined layout, thereby comprising a very large surface area. However, such appliances are relatively unsuitable when the medium flowing through the tube arrangement carries particles, such as lime, which can be deposited on the tube walls. This leads to a gradual clogging of the tube arrangement which can hardly be rectified mechanically. Moreover, the constructional effort required for the intertwined tubes is considerable.

BRIEF SUMMARY OF THE INVENTION

It is thus an objective of the present invention to improve the efficiency of a heat exchanger.

This objective is solved by providing a forced-flow heat exchanger comprising a housing of tube-shaped inside cross-section as pan of a first thermal cycle, at least one tube attached in parallel to the longitudinal housing axis as pan of a second thermal cycle, said tube(s) and said housing comprising separate inlets and outlets and each of said tubes comprising a loosely inserted flexible rod the diameter of which occupies a pan of the tube cross-section and which is freely movable and rotatable in the axial and radial tube directions.

In order to increase the efficiency such heat exchangers are usually provided with a plurality of tubes arranged in parallel to each other. With such a tube arrangement, the heat exchanger is not only very easy to construct but also easy to maintain as the tubes have no bends. The loosely inserted flexible rods are easy to extract from the tubes making the tube interiror accessible for cleaning.

The flow in the tubes can largely be influenced by the design of the flexible rods so that the heat transfer in the inner thermal cycle will be optimised by the forced flow.

The objective of the invention, being to improve the efficiency of a heat exchnager, can also be achieved by providing a forced flow in the outer thermal cycle. Such a heat exchanger comprises a housing of tube-shaped inside cross-section as part of an outer thermal cycle, and at least one tube attached in the housing as part of a second thermal cycle, said tube(s) and said housing comprising separate inlets and outlets, and wherein at least one element introduced transversely to the longitudinal housing axis is provided which fits tightly with the inside housing cross-section, comprises passages for the tube(s) and is helically executed so that the tube(s) is (are) flowed around in a helical fashion by the medium contained in the first thermal cycle. The helical element forces a flow which flows diagonally at a tangent against and around the tubes and, compared to a linear flow, is significantly more effective.

An optimal increase in the efficiency of heat exchangers results from the combination of the described forced flow in the inner and outer thermal cycles.

Below, advantages and preferred embodiments of the invention will be decribed which partly relate to the heat exchanger according to the invention having a forced flow in the inner thermal cycle, partly to the heat exchanger according to the invention having a forced flow in the outer thermal cycle, and partly to the heat exchanger according to the invention having a forced flow in the two thermal cycles.

Another decisive advantage is offered by the tubes or the tube arrangement including the loosely inserted rods which are freely movable in any direction while their freedom to move is limited mechanically only by the inner tube walls and the face walls to which they have a distance determined by design.

Due to the flexible rods, which are preferably but not necessarily cylindrical or conical, a flow characteristic is obtained which strongly differs from that of rigid rods such as metal rods and needles, respectively. This means that the loosely inserted flexible rods "swim" or "float" freely in the flowing medium, i.e. irrespetive of the heat exchanger position, so that an annular gap type flow forms between the inner tube wall and the rod. One result is that the distance to be bridged by thermal conduction is, contrary to a tube without rod, no longer equal to the inner tube radius but corresponds only to the annular gap width, thereby resulting in a substantially optimised efficiency compared to a simple tubular heat exchanger.

According to a particulary preferred embodiment of the invention, the efficiency of the heat exchanger can be significantly improved further when the rods applied have a bending strength which is greater than the bending strength of PTFE plastic and which may be slightly greater than the bending strength of glass-fibre reinforced plastic. Within this bending strength range, the effect caused by the arrangement of the loose rods is particularly evident. That is, the rods swimming in the flow do not assume a static condition but rather are stimulated to make forced vibrations, which occur because of the fact that the flow is accelerated in a narrowing gap, and therefore the flow pressure in this gap drops. As a result of the elasticity of the rods this gap can narrow even further until the viscosity forces decelerate the flow in the gap, whereafter the gap is widened again due to the reset force of the elastic rod. Afterwards, the described narrowing effect is restarted from the beginning. As the flow in the annular gap is rotationally symmetrical and the rod, as an additional degree of freedom, can also rotate, the rod will be deformed to assume a helical shape and will be caused to rotate. On the one hand, this causes the annular gap type flow to be strongly turbulent so that the heat transfer from the medium to the boundary area will be optimised. On the other hand, the forced vibration produces a strong self-cleaning effect because particles attached to the rod or the inner tube wall are detached as a result of the mechanical rod movement.

Using glass-fibre reinforced plastic (GFP) as a rod material has proved particularly advantageous.

A preferred embodiment of the invention is characterised in that the ratio between inside tube diameter and rod diameter is in the range from 1.4 to 2.5. Within this range, optimal heat transfer values can be obtained. For an inside tube diameter of 5 mm it is preferred to use rod diameters ranging between 2 and 3 mm, and for an inside tube diameter of 7 mm it is preferred to use rod diameters between 3 and 5 mm. The flow velocity of the medium between the tube and the rod should be greater than one meter per second.

Another particularly preferred embodiment of the present invention is charactefised in that the rods are executed conically over at leat part of their length. As the distance covered by the medium in the annular gap between a tube and a rod contained therein increases, the temperature of the medium and, consequently, its density and viscosity also change. Thus, by using a cylindrical rod a pressure drop would occur as the viscosity decreases, and therefore the heat transfer efficiency would deteriorate. This drawback may however be compensated by the conical design of the rods by selecting the flow direction of the medium or the position of rods so that the diameter of the rods increases as the density of the medium decreases. For ease of maintenance of the heat exchanger in this embodiment according to the invention, attention should be paid that access to the inner tube arrangement is possible from the thicker end of the rods in order to ensure that according to another embodiment of the invention in which at least one face wall of the housing is deteachably secured, maintenance is particularly easy to perform because only the face wall needs to be removed to expose the face of the tube arrangement together with the rods contained therein.

A preferred embodiment of the heat exchanger having a forced flow in the outer thermal cycle further comprises a plurality of helical elements introduced into the housing at predetermined spacings. Each element following subsequently in the axial flow direction continually stimulates the helicoidal flow during its passage through the outer thermal cycle so that a damping in axial flow direction can be counteracted. For optimising the helicoidal flow path, the spacing may be varied accordingly, and the helical elements may be turned in relation to each other so that the abating flow enters the next element optimally.

In a further preferred embodiment of the invention, the helical elements comprise in their centres a rod or rod-shaped structure of given length. This makes it possible to specify the inter-element spacing so that the elements thus executed must only be introduced into the heat exchanger housing and automatically assume the correct spacing. The helical elements can be respectively provided with one or more sealing lips for sealing with respect to the housing shell.

According to a further preferred embodiment of the invention, the inlet of the outer thermal cycle is arranged and executed such that the inflowing medium enters tangentially to the inside cross-section.

DETAILED DESCRIPTION OF THE PREFERRED EMBODIMENTS

Figures 1, 2:
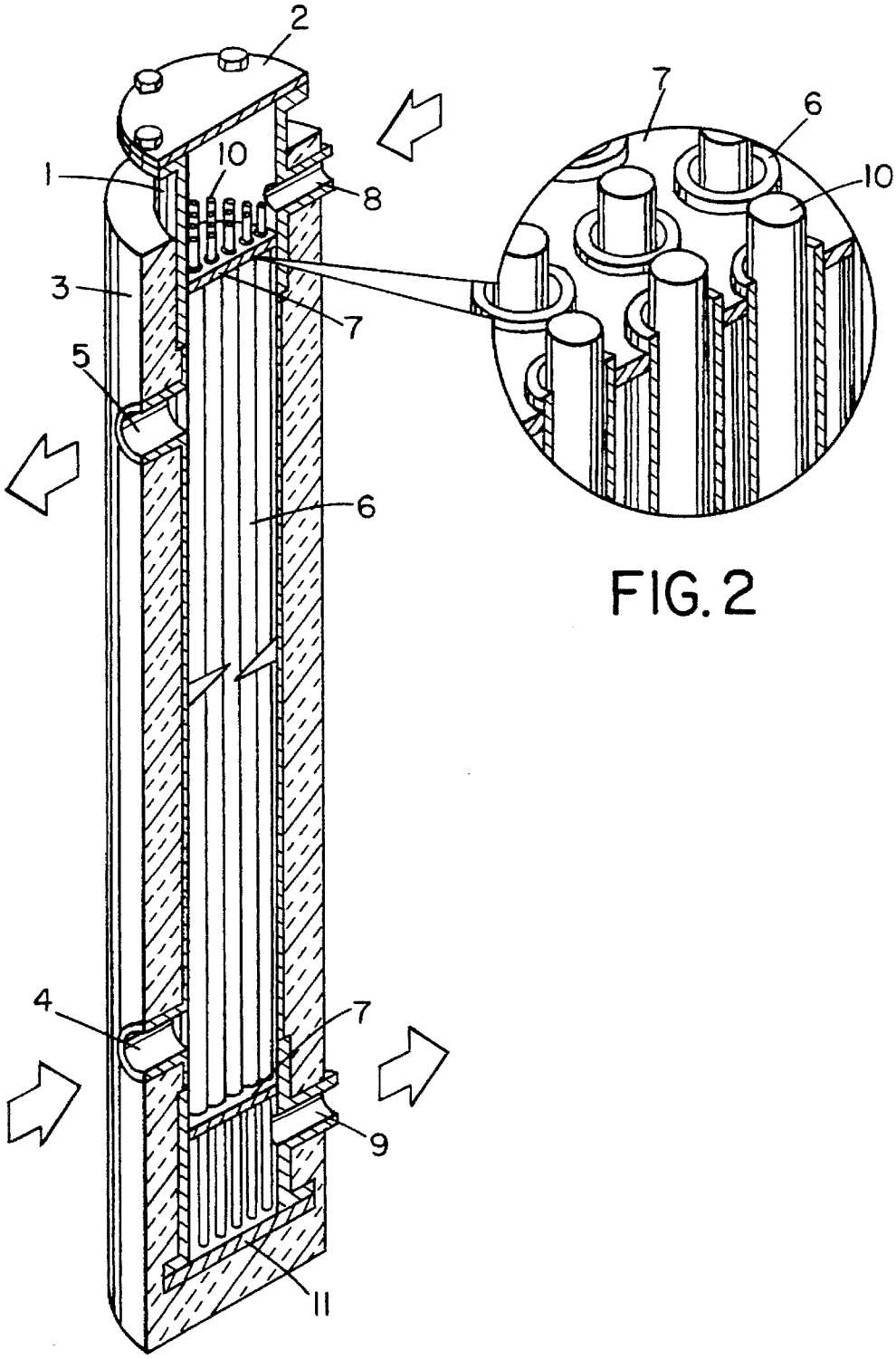
FIG. 1 shows a heat exchanger having an arrangement of a plurality of parallel tubes.
FIG. 2 shows a section of the tube arrangement.

In FIG. 1, there is shown a cross-section of a heat exchanger consisting of a tubular housing (1) closed at the faces by two circular face wall plates (2, 11). As can be seen on the face (2), the face walls (2, 11) are detachably fastened by means of bolts. The housing (1) of the heat exchanger comprises an inlet (4) and an outlet (5) for the outer thermal cycle, i.e. the cycle between the tube arrangement and the housing shell. In addition, it is surrounded by an insulating layer (3).

The interior of the tubular housing (1) contains a tube arrangement consisting of a plurality of tubes (6) arranged in parallel to each other. On the top and bottom sides of the tube arrangement, the tubes (6) are fastened in tube sheets (7). These tube sheets (7) separate the primary and secondary cycles, or the outer and inner thermal cycles of the heat exchanger. The remaining space between the tube sheets (7) and the face walls (2, 11 ) of the housing (1) serves as a common inlet and outlet, respectively, for the medium flowing through the individual tubes of the tube arrangement, which is supplied to the inner heat exchanger cycle through the inlet (8) and leaves the inner heat exchanger cycle through the outlet (9).

Cylindrical rods (10) having a diameter smaller than the inside diameter of the tubes (6) are inserted in the tubes (6). The cylindrical rods (10) are longer than the tubes (6) but shorter than the inside length of the housing (1), so that when the rods (10) are placed in the tubes (6) the former are spaced apart from the face walls (2, 11), thereby having an axial freedom to move. As the heat exchanger of the embodiment is arranged in a standing position, the loosely inserted cylindrical rods drop down onto the bottom face wall ( 11 ) and rest on it.

In FIG. 2, there is shown an enlarged section from the upper tube end area. It will be evident that the tubes (6) are routed through openings in the tube sheet (7). As the outer cycle medium flows below the top tube sheet (7) and the inner cycle medium enters the corresponding annular gaps formed between the tubes (6) and the cylindrical rods (10) above the tube sheet (7), the tubes (6) must be tightly connected to the tube sheet (7). This can be ensured, for example, by press fits or, depending on the material used, by welded or soldered joints.

When a medium enters the inner heat exchanger cycle through the inlet (8) in the direction of the arrow, even if the heat exchanger does not stand vertically as illustrated, the rods (10) are displaced by the flow in the direction of the face wall (11) until they contact it and rest against it. When the bending strength of the rods (10) is in the range defined by the claims, the effect described earlier in detail occurs in a particularly advantageous manner so that the rods (10) are stimulated to make forced vibrations. As the cylindrical rods are only loosely inserted, they are able to move both axially and transversely to the longkudinal axis and can additionally perform rotary movements. It has been shown that a flow velocity of the medium greater than 1 meter per second is preferable for stimulating such vibrations.

As a rod material having sufficient bending strength, glass-fibre reinforced plastic (GFP) is particularly suitable.

Alternatively, it is also possible to use special steel tubes which are closed at both ends and have the same or approximately the same modulus of elasticity as GFP. Such special steel tubes prove particularly favourable when there is a danger of erosion. Rod material including PTFE plastic or teflon-coated PTFE plastic has proved less suitable.

As a result of the forced vibrations performed by the rods (10) in the tubes (6), the flow in the annular gap type channels between the rods and the tube walls becomes strongly turbulent. This improves the heat transfer to the tube wall significantly compared to a laminar flow. At the same time, the forced vibrations of the rods (10) cause dirt particles deposited on the rods or the inner tube wall to be released and flushed out, or prevent particles from being deposited in the first place. The self-cleaning effect thus obtained significantly extends the maintenance-free periods of the heat exchanger. Should however maintenance become necessary, this can be carried out in a particularly simple manner. The face wall (2) can simply be removed from the housing (1) by means of the detachable connections so that the tubes and the rods are freely accessible. The rods (10) can then be extracted from the tubes (6) and cleaned. Also the inner tube walls are then freely accessible for cleaning.

The ratio between the diameter of rods (10) and the inside diameter of tubes (6) can be varied according to application. A range between 1.4 and 2.5 has been found particularly suitable. By varying the rod diameter, the heat exchanger can be adjusted optimally with respect to flow velocity and pressure drop to obtain the required heat transfer performance so that a highest possible efficiency can be attained for each field of use. The hitherto described efficiency increase of a heat exchanger related to measures taken in the inner cycle, i.e. applying to the tube arrangement. However, as shown below, it is also possible to increase the efficiency of a heat exchanger by means of measures according to the invention taken in the outer thermal cycle.

Figure 3:
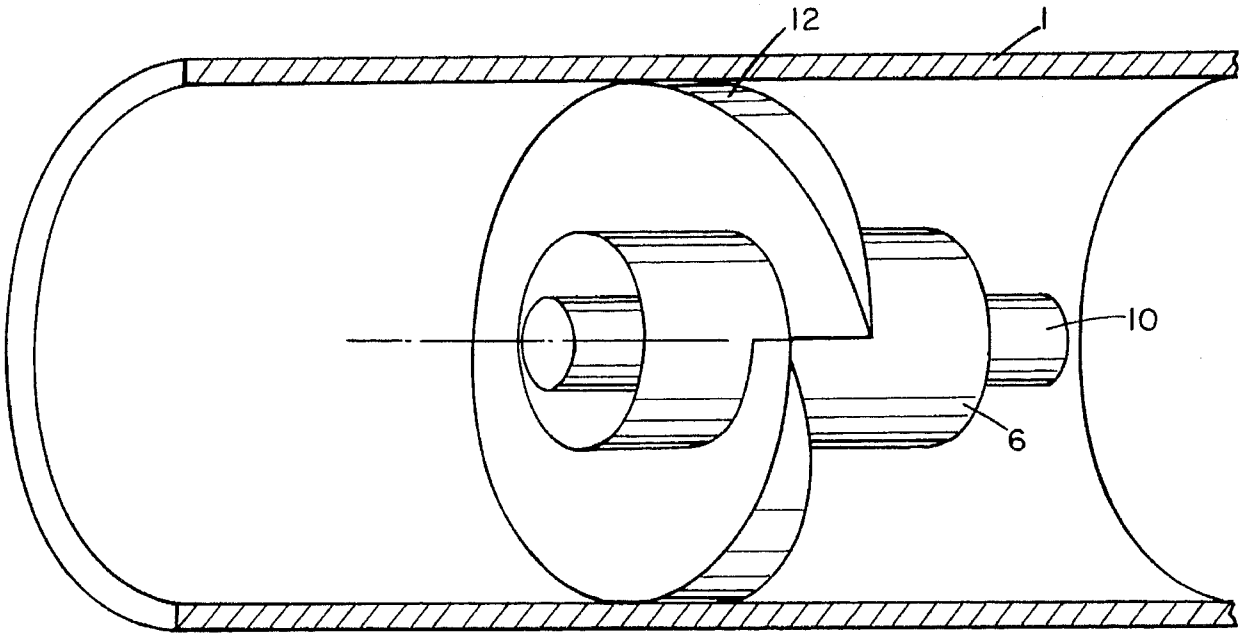
FIG. 3 shows an enlarged perspective view of another embodiment with a single tube and a helical element.

FIG. 3 will be used to explain the principle of increasing the efficiency in the outer cycle of a heat exchanger. It shows a section of a heat exchanger which may be constructed as the heat exchanger known from FIG. 1. Instead of the tube arrangement known from FIG. 1, however, only one tube (6) is provided in which a rod (10) is placed. The tube (6) is contained within the known housing (1), and is routed through the centre of a helical element (12). The helical element (12) fits tightly with the inner shell surface of the housing 1.

The helical element (12) can, for example, be made from a cylindfically shaped material by milling a thread therein. It could, however, also be cast in a mould or, when hotmelting material such as plastic is used, it could be injected.

When the medium flows in the outer cycle of the heat exchanger the element (12) causes a helical or spiral flow to occur. As a result, the outer medium flows around the tube (6) diagonally at a tangent. The diagonal nature of the flow is dependant on the thread pitch or, in other words, on the angle of flow against the helical element (12). Accordingly, the medium flowing in a spiral path in the outer thermal cycle covers a longer distance than a medium flowing in a linear path, i.e. parallel to the tube (6), would cover. Therefore, the exchange of heat is performed over a shorter distance compared to heat exchangers having a linear flow. However, the efficiency increase is not only obtained by extending the effective distance in relation to the flowing medium; but also in that the tube (6) is flowed against tangentially and the flow is generally more turbulent than a linear flow, so that the heat uptake related to the total volume of the flowing medium is optimised.

Using the helical elements (12) in the outer thermal cycle does not however mean that the inner thermal cycle must do without a tube bundle arrangement. That it to say that the helical elements can be provided with a plurality of bores through which the tubes (6) of a tube arrangement can be guided.

Figure 4:
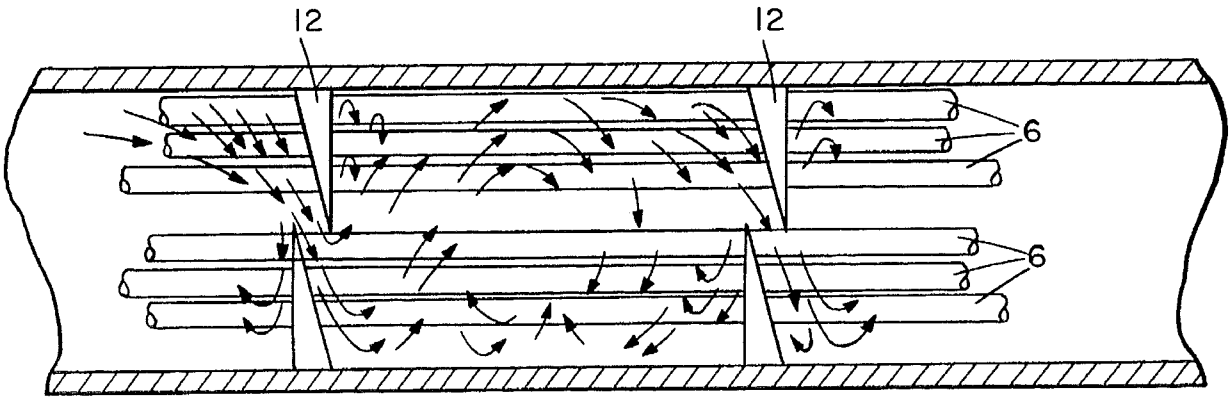
FIG. 4 shows an enlarged plan view of FIG. 1 with multiple tubes and a helical element.

A section of such a tubular heat exchanger is shown in FIG. 4.

Figure 5:
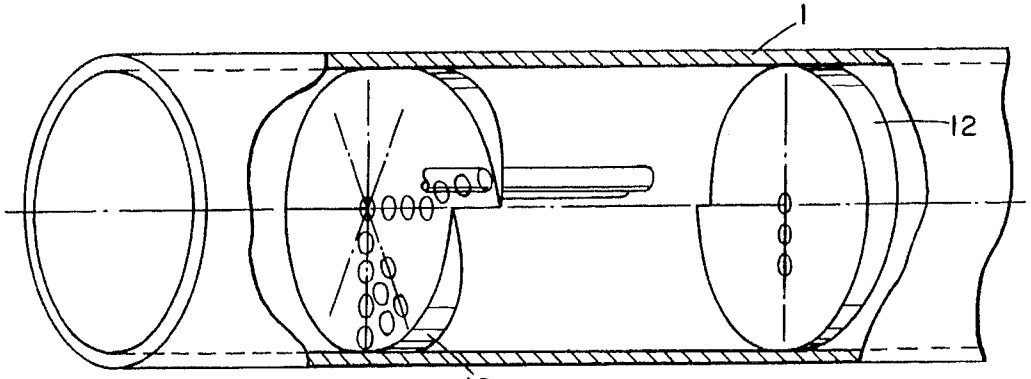
FIG. 5 shows an enlarged perspective view of FIG. 4 showing the relation of adjacent helical elements.

The housing (1) of the tubular heat exchanger contains two helical elements (12) at a presettable distance through which a number of tubes (6) is routed. The flow path ensuing in the outer thermal cycle is schematically indicated by flow lines. It is clearly seen that a spiral or helical flow ensues which flows around the tubes (6) diagonally at a tangent. The spiral flow produced by the first helical element (12) (from left to fight) is dampened by its own viscosity by the tubes so that it is attenuated more and more along the path through the housing (1). At any position, however, it can again be picked up by another helical element and stimulated once again at a given pitch. Thus, the corresponding arrangement of helical elements can influence the entire flow path in the outer thermal cycle. When the flow is to be restimulated by a helical element at any position in the housing (1), the element (12) may be turned around its longitudinal axis to be introduced such that the flowing medium optimally enters the helix opening. By way of example, FIG. 5 shows two elements (12) in a housing (1) which are turned by 180° in relation to each other.

Figure 6:
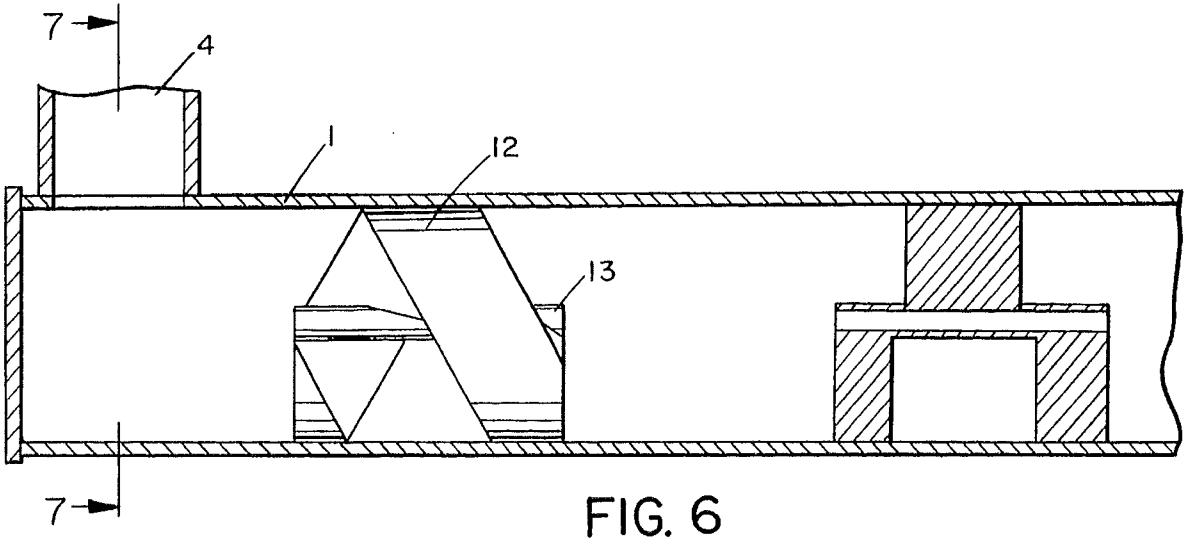
FIG. 6 shows an enlarged plan view of another embodiment of the helical element.

FIG. 6 illustrates a section of a heat exchanger having a housing (1) and an inlet (4) for the outer thermal cycle into which helical elements are introduced the execution of which differs somewhat from those shown above. As already indicated, the execution of the element (12) as regards size, flow angle, material etc. may be adapted to the respective circumstances. The helical element (12) shown in FIG. 6 comprises at its centre a rod shaped structure (13) having a length identical to that of the element. This rod shaped structure serves the stability of the element. The rod shaped structure (13 ) may however be longer at both sides than the element (12) itself. In a preferred embodiment according to the invention, it may project at both sides beyond the element to such an extent that the element can be used to automatically adjust the spacing to the next element which also comprises a rod shaped structure. Consequently, the elements (12) need not be additionally fixed in the housing (1) but rather simply to be inserted in the housing so that they will automatically be arranged at the correct spacing to each other by the rod shaped structures (13 ). Additional sealing lips may be provided on the element (12) for sealing between the housing shell and the element (12).

Figure 7:
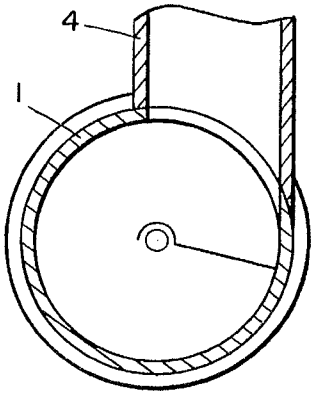
FIG. 7 shows a top view of the device in FIG. 6.

In order that the helical or spiral flow in the outer cycle be stimulated as optimally as possible from the very beginning, the inlet (4) maybe mounted to the side of the housing (1), as shown in FIG. 7, so that a flow path tangential to the housing cross-section is already obtained when the medium flows in.

Figures 8, 8A, 8B:
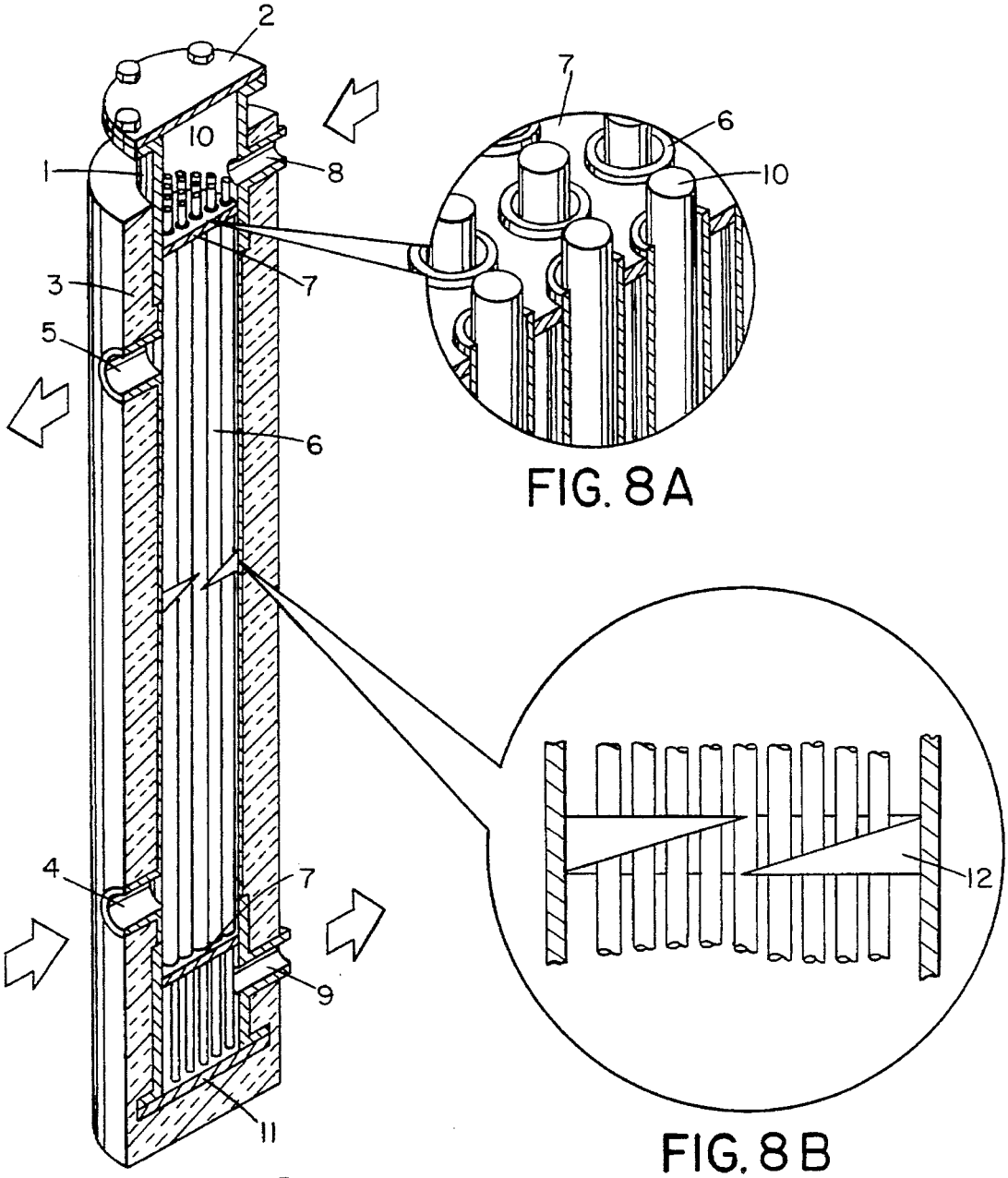
FIGS. 8, 8A and 8B, show views similar to FIGS. 1–3 with enlarged views of the tube arrangement and helical element.

FIG. 8 shows the tubular heat exchanger already known from FIGS. 1 and 2. An additional helical element (12) is schematically introduced into the outer thermal cycle and shown enlarged in the section with the tubes. As a result of the interaction between the two measures, i.e. the helical elements in the outer thermal cycle and the mandrils or rods in the tubes, it is possible to produce heat exchangers of a most compact design which are systematically adjustable to the conditions of use, such as desired temperature and pressure differences and flow velocities of the corresponding medium. Such heat exchangers offer a great variety of possible applications. They combine all the benefits of a plate heat exchanger, such as small dimensions, high heat transfer capacity, wide range of capacity in one and the same size, with the advantages offered by a tubular heat exchanger, such as easy cleaning, low pressure drops, high static pressures. By optimising the flow in and around the tubes it is possible to attain a very long service life.

It will be evident that there are additional embodiments which are not illustrated above but which are clearly within the scope and spirit of the present invention. The above description and drawings and therefore intended to be exemplary only and the scope of the invention is to be limited solely by the appended claims.

I claim:

1. A forced-flow heat exchanger comprising:

a housing of tubular inside cross-section as part of an outer thermal cycle;

at least one tube attached in parallel to the longitudinal housing axis as part of an inner thermal cycle, wherein said tube and said housing comprise separate inlets and outlets; and wherein each of said tubes comprises a loosely inserted rod formed from a flexible material and having a diameter which occupies a part of the inside tube cross-section so that said rod is freely movable and rotatable in the axial and radial tube directions.

2. A heat exchanger as claimed in claim 1, wherein the bending strength of each rod is in the range $$2\,S_{GFP}-S_{PTFE}>S>S_{PTFE}$$

where "$S_{GFP}$" iS the bending strength of glass-fibre reinforced plastic and "$S_{GFP}$" iS the bending strength of PTFE plastic.

3. A heat exchanger as claimed in claim 1, wherein said flexible material is glass-fiber reinforced plastic.

4. A heat exchanger as claimed in claim 1, wherein said flexible material is special steel tubing having a modulus of elasticity approximately equal to that of glass-fiber reinforced plastic.

5. A heat exchanger as claimed in claim 1, wherein the ratio between inside tube diameter and rod diameter is in the range from 1.4 to 2.5.

6. A heat exchanger as claimed in claim 1, wherein the medium flowing through the tubes has a flow velocity greater than one meter per second.

7. A heat exchanger as claimed in claim 1, wherein the rods, over at least part of their length, are formed having a conical shape.

8. A heat exchanger as claimed in claim 1, wherein at least one face wall (2,11) of the housing is detachable.

9. A forced-flow heat exchanger comprising:

a housing of tubular inside cross-section as part of an outer thermal cycle;

at least one tube attached in parallel to the longitudinal housing axis as part of an inner thermal cycle, wherein said tube and said housing comprise separate inlets and outlets;

at least one element introduced transversely to the longitudinal housing axis which fits tightly with the inside cross-section, and comprises passage for said tube, and is formed in a helical shape so that said tube is flowed around in a helical fashion by the medium contained in the outer thermal cycle; and wherein each of said tubes comprises a loosely insert rod formed from a flexible material and having a diameter which occupies a part of the inside tube cross-section so that it is freely movable and rotable in the axial and radial tube directions.

10. A heat exchanger as claimed in claim 9, wherein a plurality of helical elements is introduced into the casing at a given spacing.

11. A heat exchanger as claimed in claim 10, wherein the helical elements are turned in relation to each other at a given angle.

12. A heat exchanger as claimed in claim 9, wherein the helical elements comprise a rod or a rod-shaped structure of a given length in their center.

13. A heat exchanger as claimed in claim 9, wherein the inlet of the outer thermal cycle is disposed so that the inflowing medium flows tangentially to the inside housing cross-section.

* * * * *